United States Patent [19]

Kissel

[11] Patent Number: 4,631,628

[45] Date of Patent: Dec. 23, 1986

[54] ELECTRONIC FUEL INJECTOR DRIVER CIRCUIT

[75] Inventor: William R. Kissel, Milford, Mich.

[73] Assignee: Chrysler Motors Corporation, Highland Park, Mich.

[21] Appl. No.: 502,410

[22] Filed: Jun. 8, 1983

[51] Int. Cl.[4] ..... H01H 47/32

[52] U.S. Cl. ..... 361/154; 123/490

[58] Field of Search ..... 361/152, 153, 154, 155; 123/490

[56] References Cited

U.S. PATENT DOCUMENTS 4,176,387 11/1979 Harper ..... 361/154

4,180,026 12/1979 Schulzke et al. ..... 123/32 EF

FOREIGN PATENT DOCUMENTS 27530 3/1981 Japan ..... 361/154

*Primary Examiner*—Michael L. Gellner

*Attorney, Agent, or Firm*—Mark P. Calcaterra

[57] ABSTRACT

A method of and apparatus for controlling the energization of an electromagnetic fuel injection valve in response to the production of an injector control pulse in an electronic fuel injection system. The driver circuit operates a current regulating power transistor into saturation until the current through the solenoid coil of the injector valve attains a predetermined peak current value. A comparator circuit deactivates the power transistor to stop the build-up of current through the coil. A switched free-wheeling circuit is enabled, remains activated, and starts conducting when the power transistor is deactivated by the comparator circuit so that some current continues to be supplied to the solenoid coil when the power transistor is off, thereby causing the current through the coil to decay slowly. When the solenoid current has decayed to a predetermined hold current level, the comparator circuit reactivates the power transistor and thereafter, due to hysteresis in the comparator circuit, cycles the power transistor on and off to substantially maintain the current through the coil at the predetermined hold current level. At the end of the injector control pulse, both the current regulating power transistor and the switched free-wheeling circuit are deactivated. Then, through multiple power dissipation pathways momentarily activated by the avalanching of a zener diode in series with the injector's solenoid coil, the energy stored in the solenoid coil and the current through the coil diminish rapidly to zero.

4 Claims, 2 Drawing Figures

10
14
16
12
D1
R2
1K
D3
Q4
R6
10K
R5
360Ω
.001uf
C13
D9
R10
180K
.001uf
C11
R8
0.2Ω
W.W.1%
Injector 1
Injector 2
Switched Battery
30
R7
360Ω
R12
220K
D28
22
28
R29
1meg
R27
2.7K
.005uf
C30
Q120
R17
360Ω
D16
50V
68Ω W.W.
R15
Q20
Q21
24
4.7K
R26
R18
1K
R24
4.7K
34
R22
3.3K
D23
R25
1K
R121
4.7K
C19
.005uf
18
Q9
INJ
R67
1K
R60
1K
17
Injector Control (INJ)
20
5.0 Volts Output From Power Supply

ELECTRONIC FUEL INJECTOR DRIVER CIRCUIT

BACKGROUND AND SUMMARY OF THE INVENTION

The present invention relates to electronic fuel injection systems for internal combustion engines and in particular to an electronic control circuit for controlling the energization of electromagnetic fuel injection valves.

With the ever increasing demands on fuel economy and emissions control for vehicles, the application of electronically controlled fuel delivery systems has become increasingly prevalent. Recently, with the advent of powerful, inexpensive microprocessors, these controllers have become highly sophisticated, monitoring and/or precisely controlling such engine parameters as fuel-air ratio, ignition timing, ambient air and exhaust gas temperatures, oxygen in the exhaust system, etc. Particularly in the area of emissions control, current technology relies on extremely precise control of fuel-air ratio. For example, three-way catalysts have a fuel-air ratio "window" of only approximately one percent within which they operate reasonably efficiently on all three emission components; namely hydrocarbon (HC), carbon monoxide (CO) and oxides of nitrogen (NOx). Excursions of the fuel-air ratio outside this window not only result in low conversion efficiency during the excursion, but also reduce the operating temperature of the catalyst thereby resulting in a loss of conversion efficiency for a period after the fuel-air ratio has been brought back within the window.

In throttle body injection systems, the metering of fuel is controlled by an electromagnetic injection valve. A fuel injector typically comprises a precise orifice which is connected through a solenoid valve to a source of pressurized fuel. The valve is actuated via energization of the solenoid coil by a pulsed electrical signal characterized by a pulse width (PW) and a frequency (f). The amount of fuel delivered is thus given by the formula:

$$\text{Fuel Flow} = PW \times f \times C;$$

wherein C is a constant determined in accordance with the size of the orifice and fuel pressure.

Because pulse widths can be as small as a millisecond in typical applications, the mechanical delay in the operation of the solenoid valve becomes significant, requiring the above approximation to be refined. The delay in opening the solenoid valve depends on the rate at which current through the coil builds—i.e., voltage—while the closing delay is essentially fixed. Accordingly, a more useful relationship is expressed as follows:

$$\text{Fuel Flow} = (PW + \text{Offset (V)}) \times f \times C.$$

Experience has shown that, in order to obtain consistent delays or "offsets", it is desirable to initially allow the injector current to build to a high value until the valve begins to move and then reduce the injector current to a lower or "holding" value for the remainder of the solenoid pulse to avoid excessive heating of the injector winding. At the end of the pulse, the injector current is then rapidly decayed by allowing a large induced voltage to develop in the winding of the solenoid.

In multipoint fuel injection systems, the above control sequence is typically accomplished by operating a power transistor into saturation until the desired peak current is reached, turning the transistor off briefly until the injector current decays to the desired "hold" value, and then maintaining the "hold" current by operating the transistor in its active region until the transistor is turned off at the end of the pulse. However, because of high transistor power dissipation in the active "hold" region, relatively large heat sinks are required. While such heat dissipation is managable in multipoint fuel injection systems where the individual injectors are fairly small, in throttle body fuel injection systems where a single large injector is utilized to meter fuel flow, the increased force required to move the injector valve requires significantly higher current levels, resulting in commensurately higher levels of heat. For example, the current requirements of a multipoint fuel injector typically are I-peak/I-hold of 2A/0.5A respectively, while those of an exemplary single point fuel injector are 6–8.8A/1.5A. Thus, in automotive throttle body fuel injection applications, the active region method of maintaining "hold" currents may become impractical due to the difficulty of dissipating the increased levels of heat generated.

As a potential solution to this problem, it has been proposed that the desired injector holding current be maintained by rapidly switching the power transistor on and off at an appropriate switching frequency. This approach is taught, for example, in Schultzke et al., U.S. Pat. No. 4,180,026, assigned to Robert Bosch GmbH. The disadvantage of this approach, however, is that the induced voltage which develops in the injector winding during the periods when the transistor is turned off causes the injector current to decay rapidly during shut-off, thus requiring a relatively high switching frequency to avoid injector "chatter" and maintain the desired average holding current level. High switching frequencies can, however, cause switching dissipation and radio frequency interference problems. In addition, performance of the injectors may be less than optimal, particularly at small injector pulse widths.

Accordingly, it is the primary object of the present invention to provide an improved control circuit for an electronic fuel injection system.

In addition, it is an object of the present invention to provide an improved electronic fuel injection control circuit which produces highly consistent delays in the actuation of the fuel injector valve.

Furthermore, it is an object of the present invention to provide an electronic fuel injection control circuit which is capable of precisely controlling relatively large single port fuel injectors without creating a heat dissipation problem.

It is also an object of the present invention to provide an electronic fuel injection control circuit which provides improved linearity in the operation of the fuel injector.

Additional objects and advantages of the present invention will become apparent from a reading of the detailed description of the preferred embodiment which makes reference to the following set of drawings in which:

DETAILED DESCRIPTION OF THE PREFERRED EMBODIMENT

Figure 1:
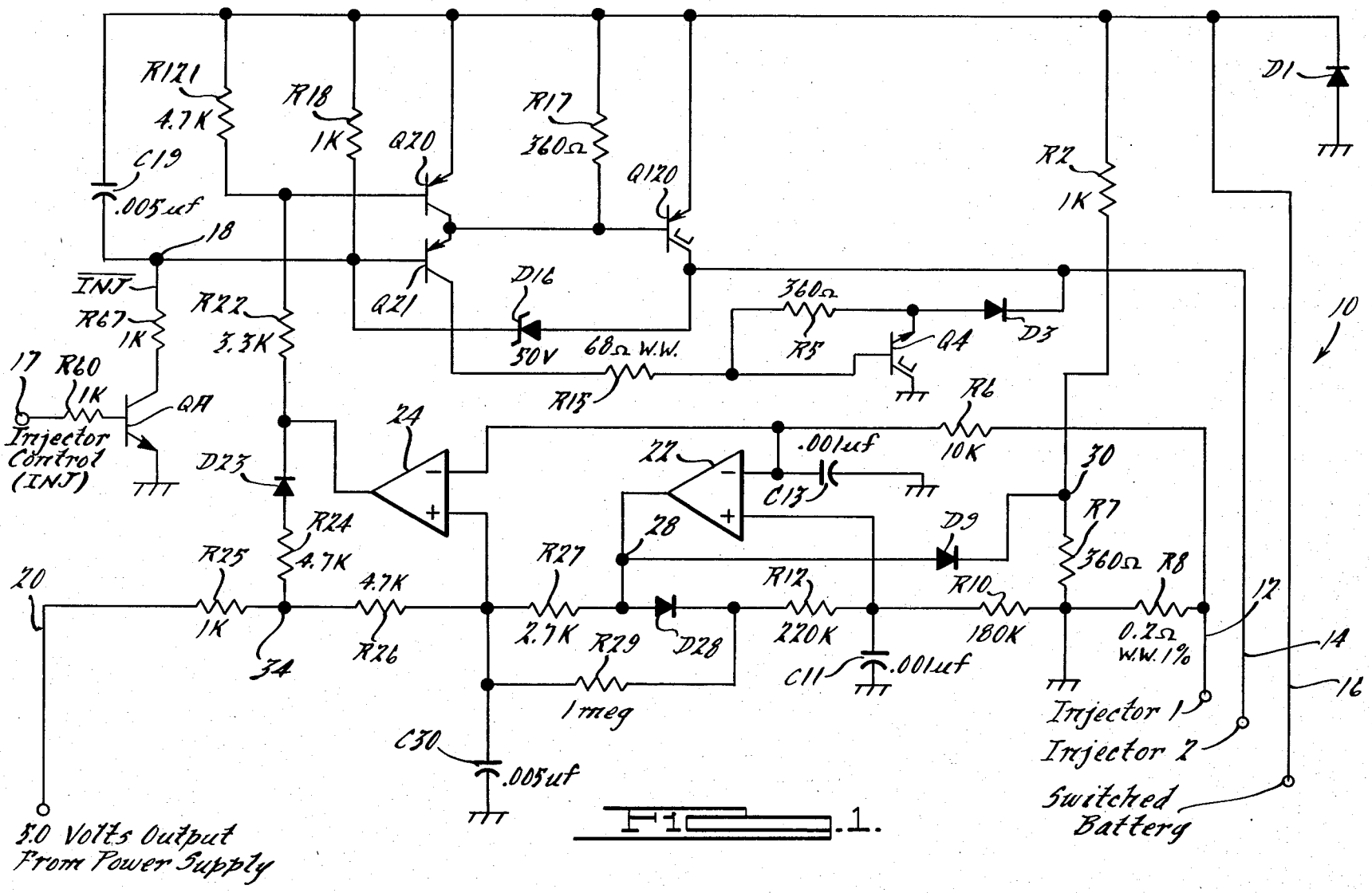
FIG. 1 is a circuit diagram of an electronic fuel injector driver circuit according to the present invention.

Referring to FIG. 1, an electronic fuel injector driver circuit according to the present invention is shown. While the preferred embodiment of the present invention described herein is particularly suited for application with single-point throttle-body type fuel injection systems, it will be readily apparent that the invention is equally applicable to multi-point port-type fuel injection systems as well.

The solenoid coil which actuates the injector valve is adapted to be connected across the terminals designated "Injector 1" and "Injector 2". The "Switched Battery" terminal is connected through the ignition switch of the vehicle to the battery, and the 5.0 volts supply line 20 is connected to a five volts regulated output of a power supply. The injector control pulse, which is produced by the main fuel injection control circuit (not shown) to signal the actuation of the injector, is supplied on line 17 and is designated INJ, as the presence of an injector pulse corresponds to a positive-going or HI logic pulse. The INJ signal is inverted via transistor QA to create an $\overline{\text{INJ}}$ signal on line 18. Operational amplifiers 22 and 24 are logic comparators of the open collector type adapted to produce an open (HI) signal at their output when the signal at their positive input exceeds the signal at their negative input and a LO output signal when the signal at their negative input exceeds the signal at their positive input. The transistors having a "U"-shaped designation adjacent the collector terminal, namely transistors Q120 and Q4, indicate power transistors which are mounted to a heat sink.

In general, the present fuel injector driver circuit 10 comprises a drive transistor Q120 which is connected in series with the injector coil (not shown but to be connected between the terminals labeled Injector 1 and 2), and a current sensing resistor R8 between the switched battery line 16 and ground, for controlling energization of the injector coil. Actuation of transistor Q120 is in turn controlled by switching transistor Q21 which has its base terminal connected to the $\overline{\text{INJ}}$ control line 18. Accordingly, when a HI injector control pulse on line 17 produces a LO signal on line 18, transistor Q21 is turned on, thereby forward biasing transistor Q120 and energizing the injector coil. During the injector pulse, the switching of transistor Q120 serves to regulate the current flow from line 16 to the injector coil, and this switching is controlled by comparators 22 and 24 and the current sensing resistor R8. In addition, a clamping transistor Q4 and a free-wheeling diode D3 are connected in series to the injector coil to provide a second current path to the injector coil, which (on account of the connection of transistor Q4 to transistor Q21 through resistor R15) remains enabled or activated throughout the duration of the injector control pulse, even when transistor Q120 is turned off. The purpose of this second current path will be subsequently explained in greater detail.

In operation, when an injector control pulse is produced on line 17, transistor Q21 is turned on, thereby turning on transistor Q120 and also enabling transistor Q4 to conduct when transistor Q120 is turned off and the injector coil voltage reverses itself as the coil's magnetic field begins to collapse. With drive transistor Q120 conducting as shown during time period T1 in FIG. 2, current flow through the injector coil and current sensing resistor R8 begins to build until the voltage signal across sensing resistor R8 on line 12, which is provided to the negative input of comparator amplifier 22, exceeds the reference voltage signal applied to the positive input of comparator amplifier 22. The reference signal supplied to the positive input of comparator 22 is determined by the voltage divider network comprised of resistors R25, R26, R27, R12 and R10 that is connected between the regulated 5.0 volt source on line 20 and ground. The reference voltage signal is selected so that comparator amplifier 22 will switch when the injector current reaches the desired peak value. When this occurs, the output of amplifier 22 will go LO, effectively grounding the end of the series resistor string R25, R26 and R27, and thereby dropping the threshold signal provided to the positive input of comparator amplifier 24 below the voltage signal supplied to its negative input through resistor R6 from sensing resistor R8. This in turn will cause the output of comparator amplifier 24 to also switch LO. Note that because the reference signal for comparator amplifier 22 is supplied from a point farther down the resistor string than the reference signal for comparator 24, comparator 22 will always switch first after the injector control pulse is initiated.

The output of comparator amplifier 24 is connected to the base of transistor Q20, which has its collector tied to the base of transistor Q120. Accordingly, when the output of amplifier 24 switches LO, transistor Q20 is turned on and transistor Q120 is turned off. The current through the injector coil at this instant in time has reached current level I1 shown in FIG. 2.

With transistor Q120 turned off, the current through the injector coil begins to decay as shown in time period T2 in FIG. 2, reversing the voltage across the injector coil, and causing line 14 to drop below the ground potential (i.e., zero volts). Since transistor Q21 remains on, transistor Q4 also remains enabled. When the reverse voltage induced by the injector coil on line 14 drops below the combined forward bias voltages of diode D3 and transistor Q4, transistor Q4 begins conducting and the "free-wheeling" path through transistor Q4 and diode D3 passess current into the injector coil, thereby preventing a very large reverse voltage from developing across the injector coil. Accordingly, the current through the injector coil is limited to current level I1, and as the coil's magnetic field collapses over time, the injector current will in fact decay slowly through the free-wheeling diode circuit, as illustrated in the waveform diagram shown in FIG. 2. The value of resistor R15 may be adjusted so as to achieve the desired rate of injector current decay. Eventually, the voltage across the current sensing resistor R8 will decay sufficiently so that the signal provided to the negative input of comparator amplifier 24 will fall below the new threshold signal supplied to the positive input of comparator amplifier 24, thereby causing the output of comparator 24 to switch back to a HI state, which marks the beginning of time period T3 shown in FIG. 2. The relative values of resistors R24, R25, R26 and R27 are selected (taking into account the feed forward of current from line 34 through diode D23 to the LO output of comparator 24) so that the new reference level signal provided to the positive input of comparator 24 corresponds to the desired "hold" current level designated as I3 in the current waveform diagram of FIG. 2.

With the output of comparator 24 HI, transistor Q20 is turned off and transistor Q120 is once again rendered conductive, thereby allowing the current through the injector coil to again begin to build. Due to a small amount of positive feedback (produced by the absence of current feeding forward through diode D23), the reference level provided to the positive input of comparator amplifier 24 through the series string of resistors R25, R26 and R27 is raised somewhat. Thus, the current through the injector coil is permitted to build to the upper limit of the desired hold current level designated as I2 in FIG. 2 before the voltage signal from the current sensing resistor R8 again exceeds the reference signal and causes comparator 24 to switch back to its LO state in other words, R24 and D23 form a hysteresis means and provide a hysteresis effect on the action of the comparator 24, raising the reference level signal presented to the positive input of comparator 24 via line 34 when the output of comparator 24 is HI and lowering the reference level signal when the output of comparator 24 is LO. As shown in FIG. 2, the output of comparator amplifier 24 during time period T3 will continue to cycle between its HI and LO states for the duration of the injector control pulse as the injector current oscillates between the upper limit I2 and lower limit I3 of the holding current.

Figure 2:
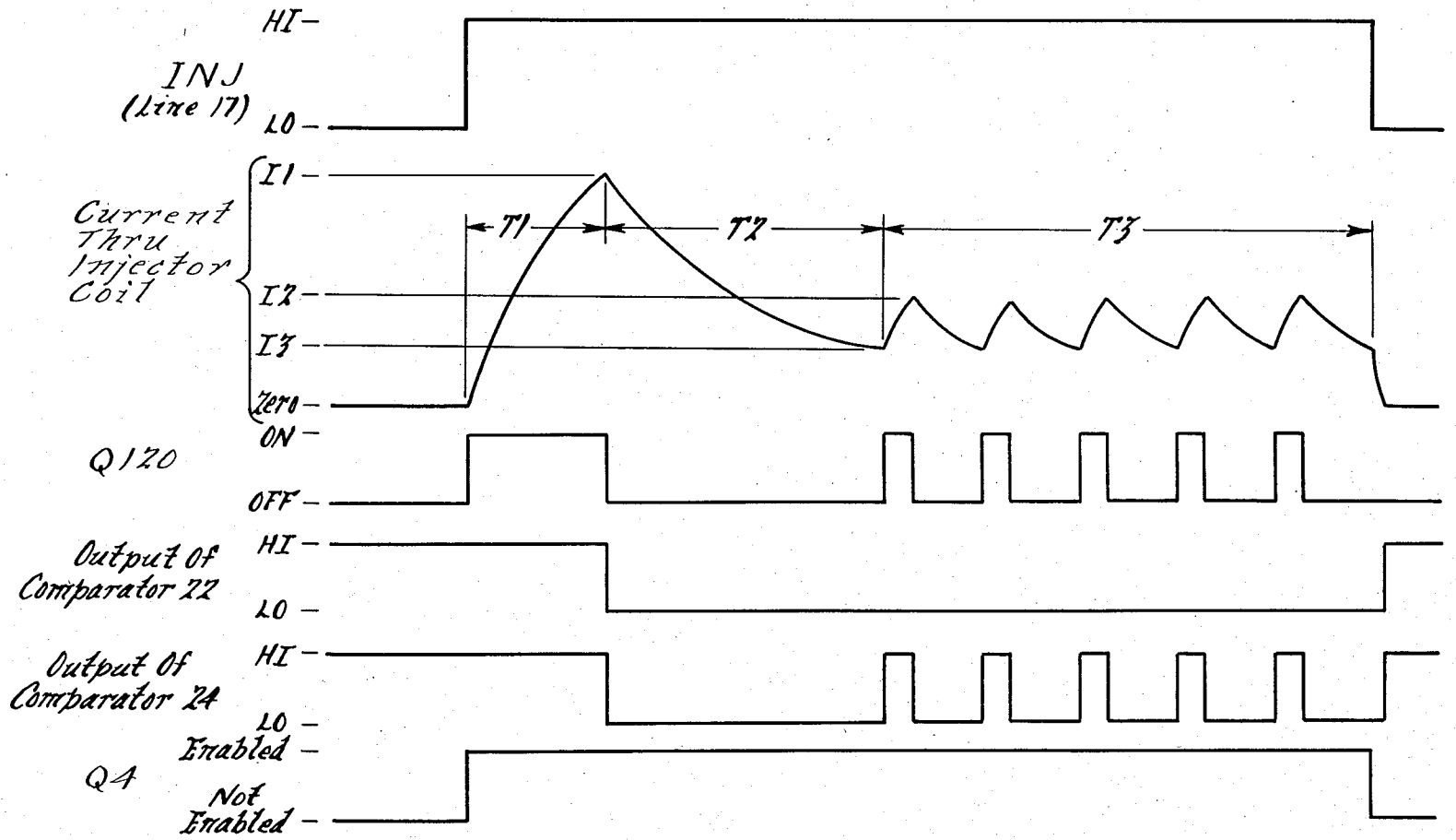
FIG. 2 is a timing diagram illustrating the operation of the electronic fuel injector driver circuit shown in FIG. 1.

At the end of the injector control pulse, which also marks the end of time period T3 shown in FIG. 2, it is necessary that the injector turn off quickly. This requires that the energy stored in the coil (i.e., inductor) also be allowed to dissipate rapidly, which is accomplished in a manner which will be described below.

When the injector control pulse on line 17 terminates (i.e., goes LO) the base-emitter bias is removed from transistor Q21 and transistor Q21 is thus turned off. This in turn removes the bias from both transistors Q120 and Q4, turning them off as well. With both transistors Q120 and Q4 non-conductive, the reverse bias voltage of the injector coil induced by the coil's collapsing magnetic field very quickly causes the voltage at line 14 to fall far below ground potential.

Multiple pathways for dissipating the energy stored in the coil are provided via the avalanching of 50 volt zener diode D16. The negative voltage induced by the collapsing field of the coil on line 14 is limited by the 50 volt zener diode D16 to approximately 50 volts below the switched battery voltage on line 16. Avalanche current drawn through zener diode D16 by the induced voltage on line 14 results in the momentary turn on of transistors Q21, Q120 and Q4 to provide the desired current paths. This avalanche current flows from line 16 through resistor R18, which biases transistor Q21 on. When transistor Q21 is on, it forward biases the emitter base junction of transistor Q120, and also provides the base drive for transistor Q4. In this manner, multiple pathways are created through the momentary conduction of transistors Q21, Q120 and Q4 for quickly dissipating the energy stored in the coil. Another result achieved is that the magnitude of the negative voltage across the injector coil is limited to a high but fixed value, which ensures fast current decay without exceeding the breakdown values of the transistors.

In case of low battery voltages on line 16, the injector current may not reach the normal initial peak current value I1. Under these conditions, the current sensing resistor R8 may not develop the necessary signal level to cause comparator 22 to change state and therefore switch to the lower injector holding current mode. This would allow a non-switched continuously high current level (greater than the holding current levels I2 or I3 but less than I1) for the duration of the injector control pulse. Under these conditions, it becomes necessary to proportionately reduce the reference bias voltage level to the non-inverting input of comparator 22 to ensure injector turn off at a reduced surge current value somewhat below current level I1. The reduced voltage reference is provided by resistors R2 and R7 and diode D9. Resistors R2 and R7 form a voltage divider between the switched battery source line 16. As the source voltage decreases, the voltage at line 30 across resistor R7 decreases correspondingly. When this voltage drops sufficiently below the voltage at line 28, i.e., the output of amplifier 22, diode D9 becomes forward biased and pulls down and clamps the voltage on line 28 to one diode voltage drop above the voltage on line 30. This action lowers the reference bias voltage on comparator 22 by an amount proportional to the reduced value of the switched battery voltage on line 16.

As the current in the injector coil decays to zero, the voltage signal across current sensing resistor R8 also drops off towards zero. A small positive reference voltage maintained on the positive input of comparator amplifier 22 by current trickling through resistors R29 and R12 to capacitor C11 ensures that the output of amplifier 22 will always be switched back to its HI state before the coil current reaches zero. In this manner, amplifier 22 is re-initialized to its HI state in preparation for the receipt by driver circuit 10 of the next injector pulse on line 17.

Thus, it will be appreciated that the present injector driver circuit initially operates the power transistor Q120 in saturation until the desired peak current is reached, and then allows the injector current to decay slowly through current-limited free-wheeling diode-transistor path while the current regulating power transistor Q120 is turned off until the desired hold current level is attained. Thereafter, the power transistor Q120 is cycled on and off at a relatively low frequency to maintain the injector current at the desired hold current level. At the end of the injector control pulse, both the power transistor and the switched free-wheeling diode path are deactivated to allow a large induced voltage and current to momentarily develop across the injector winding to facilitate very rapid but controlled decay of the power stored in the injector coil's magnetic field.

While the above description constitutes the preferred embodiment of the present invention, it will be appreciated that the invention is susceptible to modification, variation and change without departing from the proper scope or fair meaning of the accompanying claims.

I claim:

1. An electronic driver circuit for controlling the energization of a solenoid coil, forming part of an electromagnetic fuel injection valve, in response to an injector control pulse, produced by a main fuel injection control circuit, comprising:

a current regulating circuit including a power transistor connected in series with said coil, forming part of an electromagnetic fuel injection valve, and a current sensing resistor between a power source and ground, and a first switching transistor responsive to said injector control pulse, produced by a main fuel injection control circuit, for controlling the actuation of said power transistor;

a free-wheeling circuit connected in parallel with said power transistor and including a diode and a second switching transistor actuation of which is also controlled by said first switching transistor so that said free-wheeling circuit is operative to allow current to flow to said solenoid coil, forming part of an electromagnetic fuel injection valve, during said injector control pulse, produced by a main fuel injection control circuit;

a first comparator having one input thereof connected to said current sensing resistor and its other input thereof connected to receive a first reference signal from a reference circuit, said first reference signal being set so that said first comparator switches output states when the current through said coil attains a predetermined peak current value; the output of said first comparator being connected to said reference circuit for changing the value of said first reference signal when said first comparator switches output states so that said first comparator will not switch back to its original output state until the current through said coil, forming part of an electromagnetic fuel injection valve, is substantially equal to zero; and a second comparator having its output connected to a third switching transistor which is in turn connected to said power transistor for controlling the actuation of said power transistor, said second comparator having one input thereof connected to said current sensing resistor and its other input connected to receive a second reference signal from said reference circuit; said second reference signal being set so that initially said second comparator switches output states in response to said first comparator switching output states to thereby actuate said third switching transistor and deactuate said power transistor; said second reference signal being thereafter changed by the effect of the switched output state of said first comparator on said reference circuit to a voltage value substantially equal to the voltage across said current sensing resistor when the current through said coil, forming part of an electromagnetic fuel injection valve, is equal to a predetermined hold current level; said second comparator further having positive feedback for providing a hysteresis effect to said second comparator for oscillating the output of said second comparator to cycle said power transistor on and off to substantially maintain the current through said coil, forming part of an electromagnetic fuel injection valve, at said predetermined hold current level;

said free-wheeling circuit remaining actuated during the off periods of said power transistor so that the current through said coil, forming part of an electromagnetic fuel injection valve, decays slowly when said power transistor is off.

2. The driver circuit of claim 1 further comprising reduced supply voltage compensation means for automatically adjusting the desired peak current level downward in proportion to a reduction in the voltage level supplied by the power source.

3. The driver circuit of claim 2 wherein said reduced voltage compensation means comprises a diode having its anode connected to the output of said first comparator and its cathode connected to the midpoint of a voltage divider network connected between said power source and ground.

4. The driver circuit of claim 1 further comprising multiple pathway power dissipation means for rapidly and controlledly dissipating energy stored in said solenoid coil, forming part of an electromagnetic fuel injection valve, through multiple pathways upon termination of said injector control pulse, produced by a main fuel injection control circuit.

* * * * *